US012465108B1

(12) United States Patent
Taylor

(10) Patent No.: US 12,465,108 B1
(45) Date of Patent: Nov. 11, 2025

(54) CONVERTIBLE FOOTWEAR

(71) Applicant: Maia Taylor, North Chesterfield, VA (US)

(72) Inventor: Maia Taylor, North Chesterfield, VA (US)

( * ) Notice: Subject to any disclaimer, the term of this patent is extended or adjusted under 35 U.S.C. 154(b) by 234 days.

(21) Appl. No.: 18/111,093

(22) Filed: Feb. 17, 2023

(51) Int. Cl.
*A43B 3/24* (2006.01)
*A43B 1/10* (2006.01)

(52) U.S. Cl.
CPC ..... *A43B 3/246* (2013.01); *A43B 1/10* (2013.01); *A43B 3/244* (2013.01)

(58) Field of Classification Search
CPC ..... A43B 2/246; A43B 1/10; A43B 3/244
USPC ..... 36/101
See application file for complete search history.

(56) References Cited

U.S. PATENT DOCUMENTS 4,322,894 A * 4/1982 Dykes ..... A43B 3/0047 36/114
5,083,385 A 1/1992 Halford
7,346,935 B1 * 3/2008 Patterson ..... A41B 11/008 2/239
8,356,426 B1 * 1/2013 Daniel ..... A43B 13/16 36/15
10,512,302 B2 12/2019 Derrick et al.
2012/0090077 A1 * 4/2012 Brown ..... A41B 11/007 2/239
2018/0317565 A1 * 11/2018 Mccuaig ..... A41B 11/007
2022/0061455 A1 * 3/2022 Obier ..... A43B 7/20
2022/0104584 A1 * 4/2022 Bazan ..... A43B 3/244
2023/0292883 A1 * 9/2023 Aceves Tinajero ..... A43C 1/04 36/45
2023/0320460 A1 * 10/2023 Jover Todoli ..... A43B 3/246 36/103

FOREIGN PATENT DOCUMENTS

CN 211431244 U * 9/2020
WO WO-2004082416 A1 * 9/2004 ..... A43B 13/14

OTHER PUBLICATIONS

CN 211431244 U ; Sep. 8, 2020; Shen; Detachable Shoe Sole, Has Plastic Sole Frame Whose Edge Is Circumferentially Extended With Fixing Edge That Is Connected With Reinforcing Rib, Where Fixing Edge Is Formed With Multiple Shoelace Holes and Knitted Sock Is Connected With Plastic Sole Frame.*

* cited by examiner

*Primary Examiner* — Alissa J Tompkins
*Assistant Examiner* — Catherine M Ferreira
(74) *Attorney, Agent, or Firm* — Sanchelima & Associates, P.A.; Jesus Sanchelima; Christian Sanchelima

(57) ABSTRACT

A convertible footwear including a sole assembly and a socks assembly. The sole assembly includes at least one sole having suction cups equidistantly disposed on a top end thereof and protruding elements extending upward from lateral sides thereof. The socks assembly includes at least one sock having a rubber bottom. The rubber bottom is made of rubber. The at least one sock is removable attached to the at least one sole defining a footwear. The suction cups are sealed against the rubber bottom to attach the at least one sole to the at least one sock. The protruding elements enclose and cover a portion of the at least one sock.

6 Claims, 3 Drawing Sheets

CONVERTIBLE FOOTWEAR

BACKGROUND OF THE INVENTION

1. Field of the Invention

The present invention relates to convertible footwear and, more particularly, to a convertible footwear that allows interchange soles in footwear.

2. Description of the Related Art

Several designs for footwear have been designed in the past. None of them, however, include sock-like uppers having rubbered portions to be fixed to interchangeable soles.

Applicant believes that a related reference corresponds to U.S. Pat. No. 5,083,385 issued for a footwear having interchangeable uppers. Applicant believes that another related reference corresponds to U.S. Pat. No. 10,512,302 issued for a removable shoe sole system. None of these references, however, teach of a modular footwear system having multiple sock-like uppers which are removably attached to a sneaker or athletic shoe-style sole using multiple small suction cups.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a convertible footwear that includes soles having receiving elements consisting in protruding side walls having slots to ease receiving the sock-like uppers.

It is another object of this invention to provide a convertible footwear that includes vacuum suction cups to fix the uppers to the soles.

It is still another object of the present invention to provide a convertible footwear that includes sock-like uppers made of fabrics which helps to transpirate.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
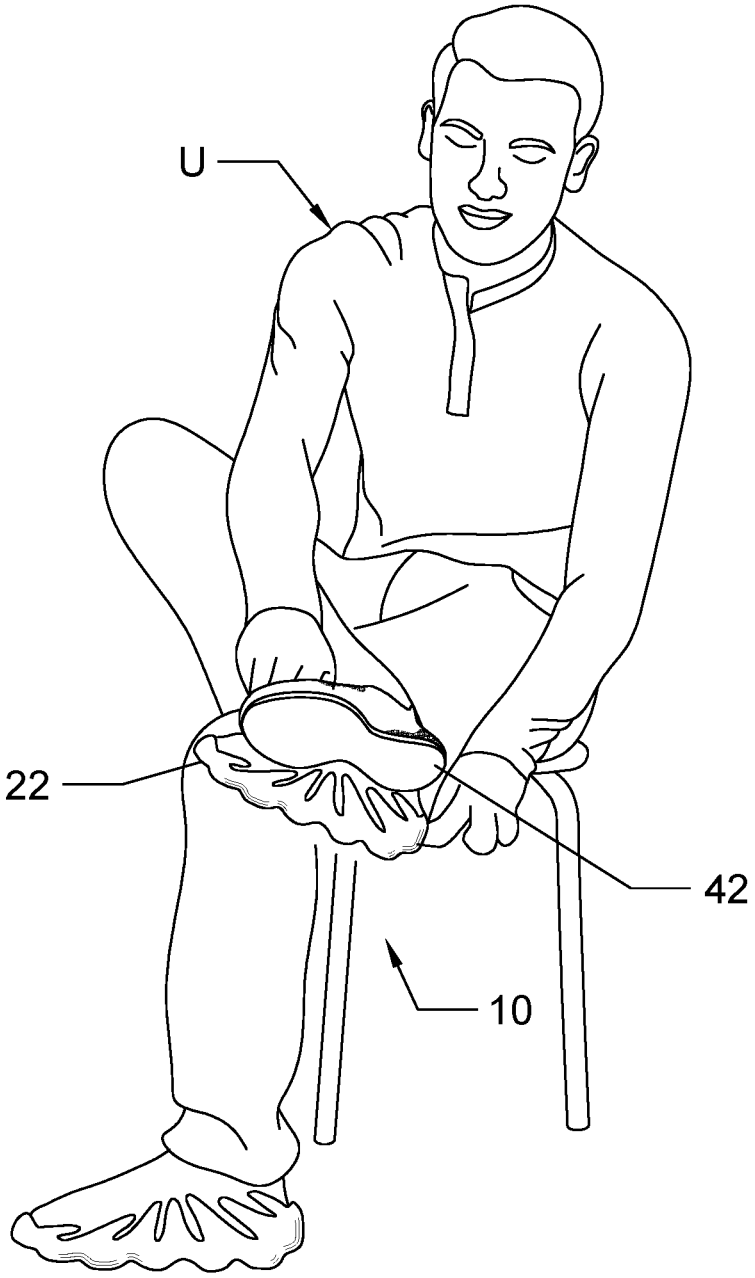
FIG. 1 represents an isometric operational view of the present invention 10 where user U is removing socks 42 from sole 22.

Referring now to the drawings, where the present invention is generally referred to with numeral 10, it can be observed that it basically includes a sole assembly 20 and a socks assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 3:
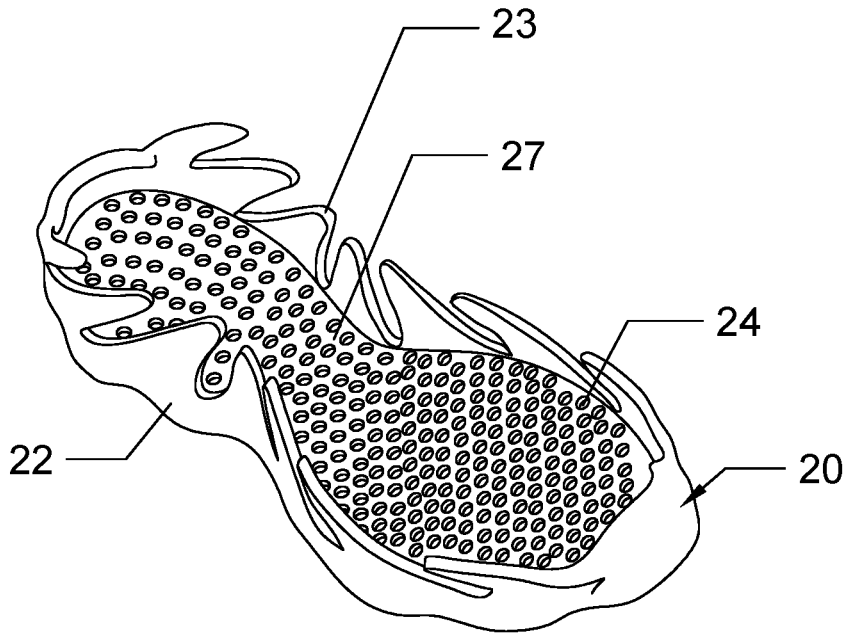
FIG. 3 illustrates isometric view of the sole assembly 20 showing a plurality of suction cups 24 attached to the top end of the sole 22.

As best illustrated in FIG. 3 the sole assembly 20 may include at least one sole 22 having a lip 25, suction cups 24 and protruding elements 23. The at least one sole 22 may be made of foam rubber. It also may be suitable for the at least one sole 22 to be made of polyvinyl chloride, polyurethane, or any other suitable material. It should be understood that the at least one sole 22 may conform to the shape of any sole known in the prior art. The at least one sole 22 may conform with the shape of sock style shoes known in the prior art. The top of the at least one sole 22 may have such a shape that conforms with the shape of the human foot. The at least one sole 22 may have a rear portion and a front portion. The rear portion of the at least one sole 22 may have a height greater than the height of the front portion of the at least one sole 22. The front portion of the at least one sole 22 may have a lip 25. Lip 25 may extend upwards and slightly bent backwards. The lip 25 may be made of polyvinyl chloride, polyurethane, or any other suitable material.

The protruding elements 23 may be located on the lateral sides of the at least one sole 22. The protruding elements 23 may extend upwardly having a predetermined inclination from the sole 22. The protruding elements 23 may be made of polyvinyl chloride, polyurethane, or any other suitable material. The sole 22 may have a curvature 27 in an uppermost end thereof. Curvature 27 may be use to define foot arch.

The suction cups 24 may be located on a top end of the at least one sole 22. The suction cups 24 may be made of polychloroprene, polyvinyl chloride, or any other suitable material. The suction cups 24 may be equidistantly disposed. A portion of the suction cups 24 may be inserted into the top end of the at least one sole 22. The suction cups 24, the lip 25 and the protruding elements 23 may be used to allow fixing the socks assembly 40 to the sole assembly 20. The suction cups 25 may be gel suction cups.

Figure 4:
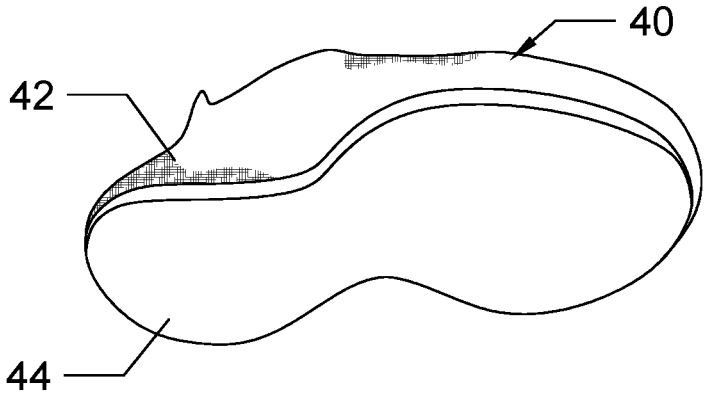
FIG. 4 is a representation of a bottom perspective view of the socks assembly 40.

Referring now to FIG. 4 it can be observed that the socks assembly 40 may include at least one sock 42 having a rubber bottom 44. The at least one sock 42 may be made of cotton, wool, polyester, or any other suitable material. The at least one sock 42 may conform to the shape of any sock known in the prior art. The rubber bottom 44 may be made of a rubber-like material. The rubber bottom 44 may fully cover a bottom end of the at least one sock 42. The straps 44 may be made of neoprene rubber, silicone rubber, nitrile rubber, or any other rubber-like material known in the prior art.

The rubber bottom 44 may have a shape that conforms with a shape of the sole 22. The rubber bottom 44 may be removable attached to the sole 22. The rubber bottom 44 may have a second curvature which conforms with the curvature of the sole 22. The protruding elements 23 may enclose the socks. The rubber bottom 44 may be fixed to the top end of the at least one sole 22 by means of the suction cups 24. The suction cups 24 may be sealed against the rubber bottom 24. In a preferred embodiment the suction cups 24 are placed in such a configuration that conforms with disposition of rubber bottom 44 on the at least one sock 42.

Figure 2:
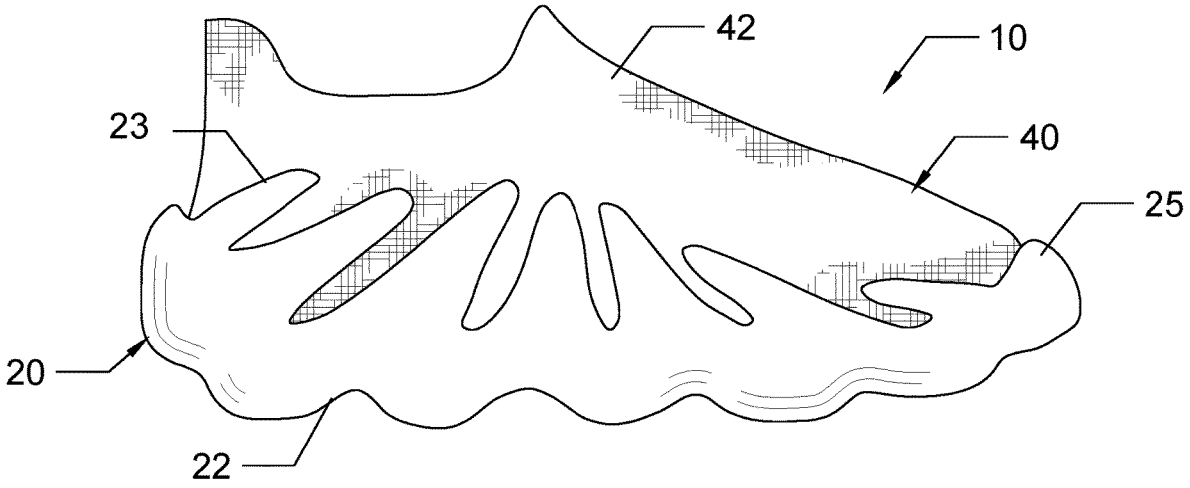
FIG. 2 shows an isometric view of the present invention 10. The present invention 10 includes a sole assembly 20 and a socks assembly 40.

The front portion of the at least one sock 42 may be covered by the lip 25. As best illustrated in FIG. 2 a sock-style shoe may be formed when attaching the at least one sock 42 to the at least one sole 22. It should be understood that the present invention 10 includes interchangeable soles 22. The soles 22 vary in shape. The present invention 10 further includes different socks 42. In a preferred embodiment the present invention 10 comprises a left sock, a right sock, a left sole and a right sole. The present invention 10 allows customization of the soles and socks while providing means to attach the socks and soles therebetween.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A convertible footwear, comprising:

a sole assembly, wherein said sole assembly includes at least one sole, wherein said at least one sole includes suction cups equidistantly disposed along a top surface thereof; said sole assembly comprises a rear portion featuring a round transition towards a front portion, wherein the rear portion has a greater height than that of the front portion, such that the at least one sole defines an inclined surface extending from a rear section toward a front section: wherein said front portion features a lip at a tip thereof, said lip extending updawrdly to define a toe cap: said sole assembly further comprises protruding elements extending from a periphery of said at least one sole, said protruding elements are configured to engage at least one sock, said protruding elements form a confinement structure that securely positions the at least one sock relative to the at least one sole, wherein the protruding elements on the sole periphery of the rear portion extend upwardly towards said front portion of the footwear, and wherein the protruding elements on the sole periphery of the front portion extend upwardly toward the rear portion of the footwear, and the protruding elements on the sole periphery of the round transition portion extend upwardly; and a socks assembly, wherein said socks assembly includes said at A least one sock which further includes a rubber bottom, said rubber bottom covering an entire bottom area of said at least one sock, wherein said rubber bottom has a predetermined height, wherein said suction cups are sealed against said rubber bottom to attach said at least one sock inside the confinement structure formed by the protruding elements, said at least one sock is detachable from said at least one sole;

wherein said at least one sole includes a first curvature in a central portion of a top end, said first curvature being configured to be an arch support; and wherein said rubber bottom of said at least one sock includes a second curvature which conforms with said first curvature of said at least one sole.

2. The convertible footwear set forth in claim 1, wherein said protruding elements feature rounded corners and a predetermined separation therebetween.

3. The convertible footwear set forth in claim 1, wherein said suction cups are partially inserted into said at least one sole.

4. The convertible footwear set forth in claim 1, wherein said at least one sole includes a right sole and a left sole.

5. The convertible footwear set forth in claim 1, wherein said at least one sock is made of a fabric material.

6. A convertible footwear, consisting of:

a sole assembly, wherein said sole assembly includes at least one sole, wherein said at least one sole includes suction cups equidistantly disposed along a top surface thereof, said suction cups are partially inserted in said at least one sole; said sole assembly comprises a rear portion featuring a round transition towards a front portion, wherein the rear portion has a greater height than that of the front portion, such that the at least one sole defines an inclined surface extending from the rear section toward the front section; wherein said front portion features a lip at a tip thereof, said lip extending upwardly to define a toe cap; said sole assembly further comprises protruding elements extending from a periphery of said at least one sole, said protruding elements are configured to engage at least one sock, said protruding elements form a confinement structure that securely positions the at least one sock relative to the at least one sole, wherein protruding elements formed on said rear portion extend towards said front portion, wherein protruding elements formed on said front portion extend toward the rear portion, wherein the protruding elements formed on the round transition extend upward; said protruding elements feature rounded corners and a predetermined separation therebetween, wherein a top surface of said at least one sole has a first curvature in a central portion of said top surface, said first curvature is configured to be an arch support; and a socks assembly, wherein said socks assembly includes at least one sock having a rubber bottom, said rubber bottom covering an entire bottom area of said at least one sock, wherein said rubber bottom has a predetermined height, said at least one sock is made of a fabric material, wherein when said at least one sock is inserted into the confinement structure formed by the protruding elements said suction cups sealed against said rubber bottom to further secure said at least one sock into said at least one sole, said lip covers a front portion of said at least one sock when said at least one sock is attached to said at least one sole, said at least one sock is detachable from said at least one sole; wherein said rubber bottom of said at least one sock has a second curvature which conforms with said first curvature of said at least one sole.

* * * * *